US011649950B2

(12) United States Patent
Tan

(10) Patent No.: US 11,649,950 B2
(45) Date of Patent: May 16, 2023

(54) LUMINAIRE

(71) Applicants: OPPLE LIGHTING CO., LTD., Shanghai (CN); SUZHOU OPPLE LIGHTING CO., LTD., Suzhou (CN)

(72) Inventor: Xingchen Tan, Suzhou (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 17/564,147

(22) Filed: Dec. 28, 2021

(65) Prior Publication Data

US 2022/0120414 A1 Apr. 21, 2022

Related U.S. Application Data

(63) Continuation of application No. PCT/CN2020/133353, filed on Dec. 2, 2020.

(30) Foreign Application Priority Data

Dec. 2, 2019 (CN) ..... 201922126088.2

(51) Int. Cl.
*F21V 17/16* (2006.01)
*F21V 5/00* (2018.01)
(Continued)

(52) U.S. Cl.
CPC ..... *F21V 17/16* (2013.01); *F21V 5/00* (2013.01); *F21V 17/12* (2013.01); *F21V 31/005* (2013.01)

(58) Field of Classification Search
CPC . F21V 17/16; F21V 5/00; F21V 17/12; F21V 31/005; F21V 19/04; F21V 17/164;
(Continued)

(56) References Cited

U.S. PATENT DOCUMENTS 7,815,338 B2 * 10/2010 Siemiet ..... F21S 4/28 362/249.02
9,423,116 B2 * 8/2016 Sieberth ..... F21S 4/28
(Continued)

FOREIGN PATENT DOCUMENTS

CN 101650000 A 2/2010
CN 101956915 A 1/2011
(Continued)

OTHER PUBLICATIONS

International Search Report of PCT Application No. PCT/CN2020/133353 dated Feb. 25, 2021 with English translation, (4p).

*Primary Examiner* — Tsion Tumebo
(74) *Attorney, Agent, or Firm* — Arch & Lake LLP

(57) ABSTRACT

A luminaire, including a shade, a mounting base, a first end cap, a second end cap, a light source module and a drive power source. The shade has two first folded edges opposite to each other, and the mounting base has two second folded edges opposite to each other; the first folded edges are in snap-fit with the second folded edges; the luminaire further includes a shade pushing assembly, and the shade pushing assembly includes a force-exerting key and a pushing piece; one end of the force-exerting key is connected to the pushing piece, and the other end of the force-exerting key extends out of the mounting base; the pushing piece abuts against a first end face of at least one of the first folded edges.

15 Claims, 6 Drawing Sheets

(51) Int. Cl.
*F21V 17/12* (2006.01)
*F21V 31/00* (2006.01)

(58) Field of Classification Search
CPC ..... F21V 15/015; F21V 31/03; F21V 3/00; F21S 8/04; F21Y 2115/10
See application file for complete search history.

(56) References Cited

U.S. PATENT DOCUMENTS

| | | | | |
|---|---|---|---|---|
| 2010/0295468 | A1* | 11/2010 | Pedersen | H05B 45/20 362/218 |
| 2011/0141734 | A1* | 6/2011 | Li | G02B 19/0028 362/335 |
| 2012/0106157 | A1* | 5/2012 | Simon | H01R 33/96 362/249.05 |
| 2015/0016100 | A1* | 1/2015 | Ishii | F21V 15/015 362/223 |
| 2015/0338053 | A1* | 11/2015 | Rector | F21V 5/02 362/223 |
| 2016/0327252 | A1* | 11/2016 | Ray | F21V 21/008 |
| 2018/0058637 | A1* | 3/2018 | Thiel | F21V 17/16 |
| 2019/0249854 | A1* | 8/2019 | Shen | F21V 15/015 |
| 2019/0338924 | A1* | 11/2019 | Vang | F21S 8/04 |
| 2020/0363024 | A1* | 11/2020 | Wang | F21S 4/28 |
| 2020/0363600 | A1* | 11/2020 | Robota | F21V 5/04 |

FOREIGN PATENT DOCUMENTS

| | | | |
|---|---|---|---|
| CN | 106895308 | A | 6/2017 |
| CN | 210860805 | U | 6/2020 |
| JP | 5529516 | B2 | 6/2014 |
| KR | 20170096859 | A | 8/2017 |

* cited by examiner

LUMINAIRE

CROSS-REFERENCE TO RELATED APPLICATIONS

This application is based upon and claims the priority of PCT patent application No. PCT/CN2020/133353 filed on Dec. 2, 2020 which claims priority to the Chinese patent application No. 201922126088.2 filed on Dec. 2, 2019, the entire contents of which are hereby incorporated by reference herein for all purposes.

TECHNICAL FIELD

The present disclosure relates to a field of lighting technology, especially relates to a luminaire.

BACKGROUND

With the development of technology in the lighting industry, lighting techniques have made great breakthroughs, and luminaires have been continuously improved in all aspects. Usually, a luminaire includes a shade, a mounting base and an end cap. In order to achieve a high level of waterproofing and dust prevention, the shade, the mounting base and the end cap are often cross-connected at the joint thereof. As a result, when detaching the luminaire, the luminaire can be detached only after the end cap is removed firstly, which leads to inconvenient detaching operation of the luminaire and low detaching efficiency.

SUMMARY

The present disclosure discloses a luminaire.

A luminaire includes a shade, a mounting base, a first end cap, a second end cap, a light source module and a drive power source. The shade has two first folded edges opposite to each other, and the mounting base has two second folded edges opposite to each other; the first folded edges are in snap-fit with the second folded edges; the first end cap and the second end cap are respectively connected to two ends of the mounting base; the shade, the mounting base, the first end cap and the second end cap form an accommodating cavity, and the light source module and the drive power source are disposed in the accommodating cavity. The luminaire further includes a shade pushing assembly, and the shade pushing assembly comprises a force-exerting key and a pushing piece; the force-exerting key is in sliding fit with a sidewall of the mounting base, and the pushing piece is located in the accommodating cavity; one end of the force-exerting key is connected to the pushing piece, and the other end of the force-exerting key extends out of the mounting base; the pushing piece abuts against a first end face of at least one of the first folded edges, and the first end face is an end face on a side, which is facing the first end cap, of the first folded edge; a movement of the force-exerting key causes the pushing piece to move for driving the shade (to slide relative to the mounting base and away from the first end cap.

It is to be understood that the foregoing general description and the following detailed description are exemplary and explanatory only and are not restrictive of the disclosure.

BRIEF DESCRIPTION OF DRAWINGS

The accompanying drawings described herein are provided for further understanding of the present disclosure, and constitute a part of the present disclosure. The examples and illustrations thereof of the present disclosure are intended to explain the present disclosure, but do not constitute inappropriate limitations to the present disclosure. In the drawings.

DETAILED DESCRIPTION

Figure 1:
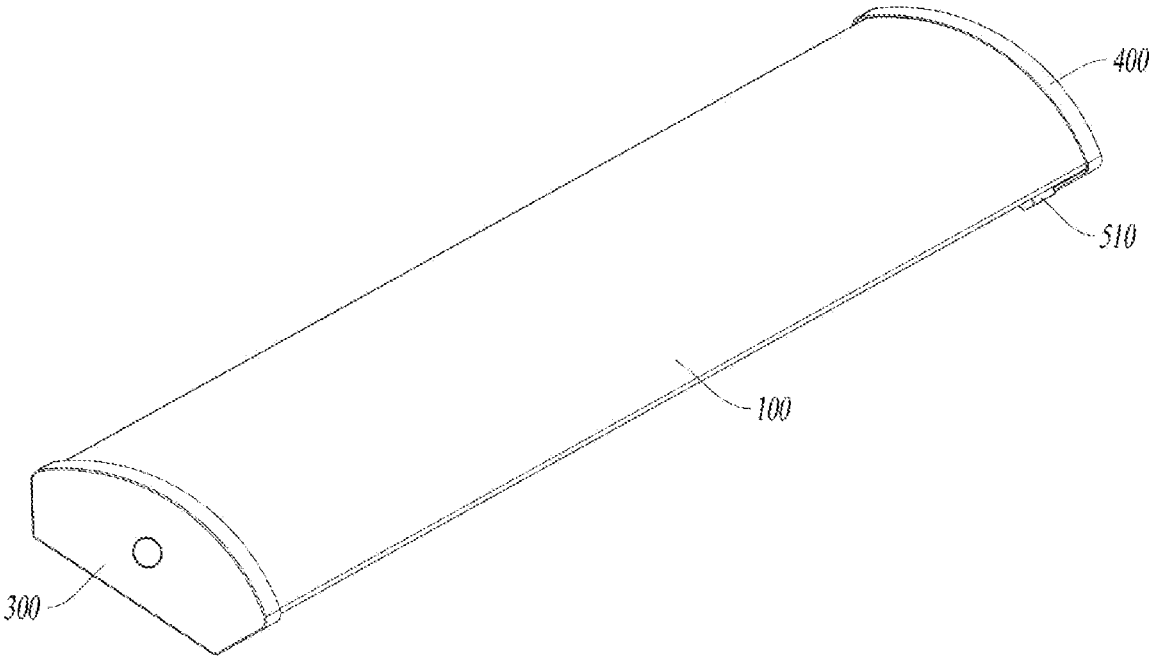
FIG. 1 is a structure diagram of a luminaire disclosed in one example of the present disclosure.

Examples of the present disclosure will be described below in combination with the accompanying drawings of the present disclosure. Apparently, the described examples are merely a part rather than all the examples of the present disclosure. All other examples that are derived from the examples of the present disclosure by an ordinary skilled in the art without creative efforts shall fall within the protection scope of the present disclosure. The reference numerals in the accompanying drawings are merely used to distinguish different steps in technical solutions from each other, rather than delimiting execution orders of the steps. The specific execution order may be referred to the description in the present disclosure.

Terms used in the present disclosure are merely for describing specific examples and are not intended to limit the present disclosure. The singular forms "one", "the", and "this" used in the present disclosure and the appended claims are also intended to include a multiple form, unless other meanings are clearly represented in the context. It should also be understood that the term "and/or" used in the present disclosure refers to any or all of possible combinations including one or more associated listed items.

Reference throughout this specification to "one embodiment," "an embodiment," "an example," "some embodiments," "some examples," or similar language means that a particular feature, structure, or characteristic described is included in at least one embodiment or example. Features, structures, elements, or characteristics described in connection with one or some embodiments are also applicable to other embodiments, unless expressly specified otherwise.

It should be understood that although terms "first", "second", "third", and the like are used in the present disclosure to describe various information, the information is not limited to the terms. These terms are merely used to differentiate information of a same type. For example, without departing from the scope of the present disclosure, first information is also referred to as second information, and similarly the second information is also referred to as the first information. Depending on the context, for example, the term "if" used herein may be explained as "when" or "while", or "in response to . . . , it is determined that".

LIST OF REFERENCE NUMERALS

100—shade, 110—first folded edge, 120—enclosing portion, 121—escape space,

200—mounting base, 210—second folded edge, 220—second waterproof piece, 230—clamping recess, 240—mounting hole, 250—wiring hole,

300—first end cap, 310—first limit space,

400—second end cap, 410—second limit space, 411—moving gap,

500—shade pushing assembly, 510—force-exerting key, 520—pushing piece, 521—third folded edge,

610—positioning portion, 620—stop portion, 630—first waterproof piece, 640—shoulder, 650—clamping projection, 660—drainage hole, 670—third waterproof piece.

Referring to FIG. 1 to FIG. 10, an example of the present disclosure discloses a luminaire including a shade 100, a mounting base 200, a first end cap 300, a second end cap 400, a light source module, and a drive power source.

The mounting base 200 is a basic component of the luminaire. The mounting base 200 can provide an installation base for other components of the luminaire. The light source module is a light-emitting assembly of the luminaire. The light-emitting assembly typically includes a light source board and an illuminator. The illuminator may be preferably a light-emitting diode (LED) illuminator which has the advantages of environmental friendliness, energy conservation, long service life, etc. The light source module is electrically connected to the drive power source, and the drive power source supplies electric energy to the light source module.

Figure 2:
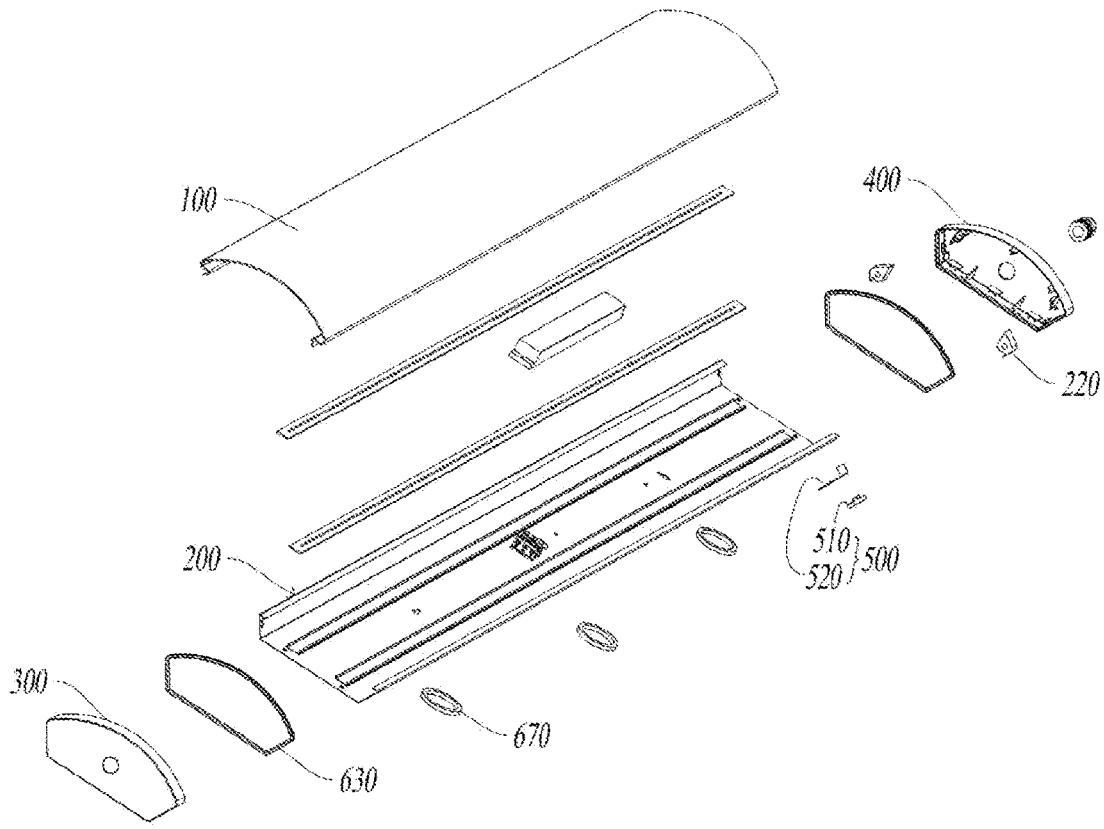
FIG. 2 is an exploded structure diagram of a luminaire disclosed in one example of the present disclosure.

The shade 100 has two first folded edges 110 opposite to each other, while the mounting base 200 has two second folded edges 210 opposite to each other. The first folded edges 110 are in snap-fit with the second folded edges 210. Thus, the shade 100 may be fixedly connected to the mounting base 200. The first end cap 300 and the second end cap 400 are connected to two ends of the mounting base 200, respectively. The shade 100, the mounting base 200, the first end cap 300 and the second end cap 400 form an accommodating cavity, and the light source module and the drive power source are disposed in the accommodating cavity. Specifically, the first end cap 300 and the second end cap 400 are capable of sealing both ends of the shade 100 and the mounting base 200 to realize waterproofing and dust prevention. The light source module and the drive power source may be mounted in a variety of ways. As shown in FIG. 2, a mounting guide groove may be formed in the mounting base 200. The light source module may be in plug-in fit with the mounting guide groove, and the drive power source may be fixed to the mounting base 200 by means of a threaded fastener (a screw, a bolt, etc.).

Moreover, the luminaire also includes a shade pushing assembly 500. The shade pushing assembly 500 includes a force-exerting key 510 and a pushing piece 520. The force-exerting key 510 is in sliding fit with a sidewall of the mounting base 200. The pushing piece 520 is located in the accommodating cavity. One end of the force-exerting key 510 is connected to the pushing piece 520, and the other end of the force-exerting key 510 extends out of the mounting base 200. In other words, a user may act on the force-exerting key 510 from the outside of the luminaire to operate the pushing piece 520 located in the accommodating cavity. The force-exerting key 510 is slid relative to the sidewall of the mounting base 200 under the force, and the pushing piece 520 reacts accordingly.

The pushing piece 520 abuts against a first end face of at least one of the first folded edges 110, where the first end face is the end face on a side, facing the first end cap 300, of the first folded edge 110. A movement of the force-exerting key 510 causes the pushing piece 520 to move for driving the shade 100 to slide relative to the mounting base 200 and away from the first end cap 300. Specifically, the pushing piece 520 may abut against any one of the first folded edges 110, and may also abut against both of the two first folded edges 110 as long as it can act on the first folded edge 110. Further, as described above, since the shade 100 needs to be moved away from the first end cap 300, the pushing piece 520 needs to abut against the end face on the side, facing the first end cap 300, of the first folded edge 110. In this way, the movement of the pushing piece 520 can cause the shade 100 to move away from the first end cap 300.

In the luminaire disclosed in this example of the present disclosure, the pushing piece 520 abuts against the first end face of at least one of the first folded edges 110, and the first end face is the end face on the side, facing the first end cap 300, of the first folded edge 110. Since the force-exerting key 510 connected to the pushing piece 520 partially extends out of the mounting base 200 and the force-exerting key 510 is in sliding fit with the sidewall of the mounting base 200, the force-exerting key 510 can be operated outside the mounting base 200 to move for driving the pushing piece 520 such that the shade 100 can be pushed to slide relative to the mounting base 200 and away from the first end cap 300. The sliding of the shade 100 relative to the mounting base 200 is achieved by means of the relative sliding between the first folded edges 110 and the second folded edges 210. When the shade 100 is moved away from the first end cap 300, a gap is formed between the shade 100 and the first end cap 300, and the shade 100 may be captured from the gap. Since the shade 100 is flexible to a certain extent, the shade 100 may be taken out of the mounting base 200 with a small force. Thus, detachment of the entire luminaire is avoided. Compared with the way where the shade can be removed only after the end caps are removed in the prior art, the operation is simpler and more convenient with higher detaching efficiency.

Specifically, the mounting base 200 may be in a plurality of connection relationships with the first end cap 300 and the second end cap 400. For example, usually, the mounting base 200 may be connected to the first end cap 300 (the second end cap 400) by means of a threaded fastener. In a preferred solution, a positioning portion 610 may be disposed in each of the first end cap 300 and the second end cap 400. A first limit space 310 is formed between the positioning portion 610 and a sidewall of the first end cap 300, while a second limit space 410 is formed between the positioning portion 610 and a sidewall of the second end cap 400. The two ends of the mounting base 200 are in limiting fit with the first limit space 310 and the second limit space 410, respectively. Specifically, the first limit space 310 and the second limit space 410 are capable of fixing and limiting the mounting base 200 to realize a fixed connection between the mounting base 200 and the first end cap 300 and a fixed connection between the mounting base 200 and the second end cap 400. Thus, waterproofing and dust prevention of the mounting base 200 are realized by means of the first end cap 300 and the second end cap 400.

Figure 4:
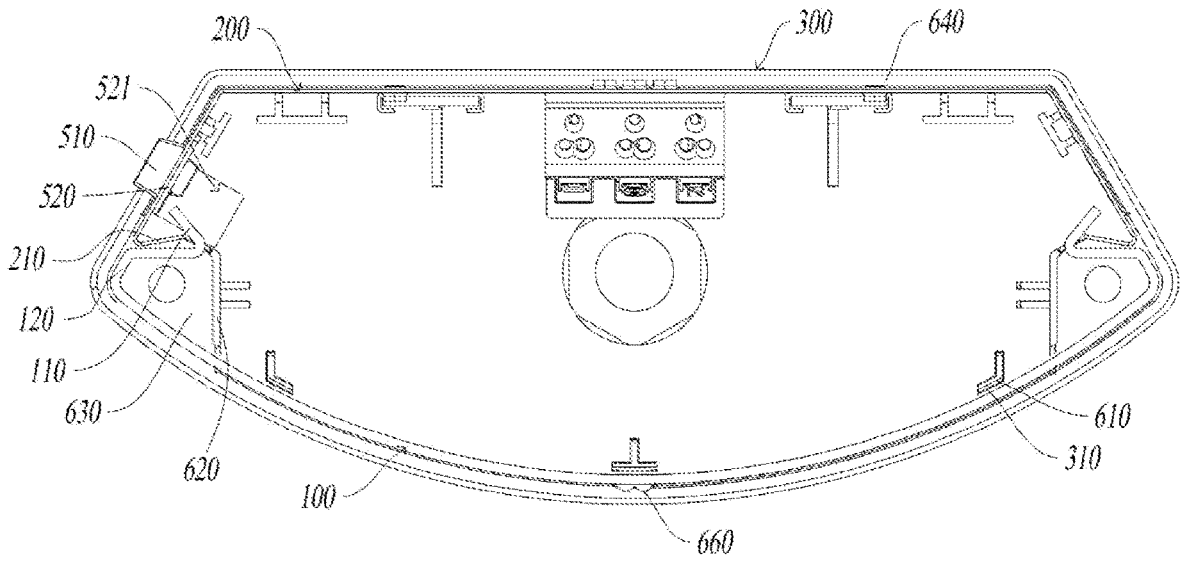
FIG. 4 is a cross-sectional view of a luminaire disclosed in one example of the present disclosure.
Figure 5:
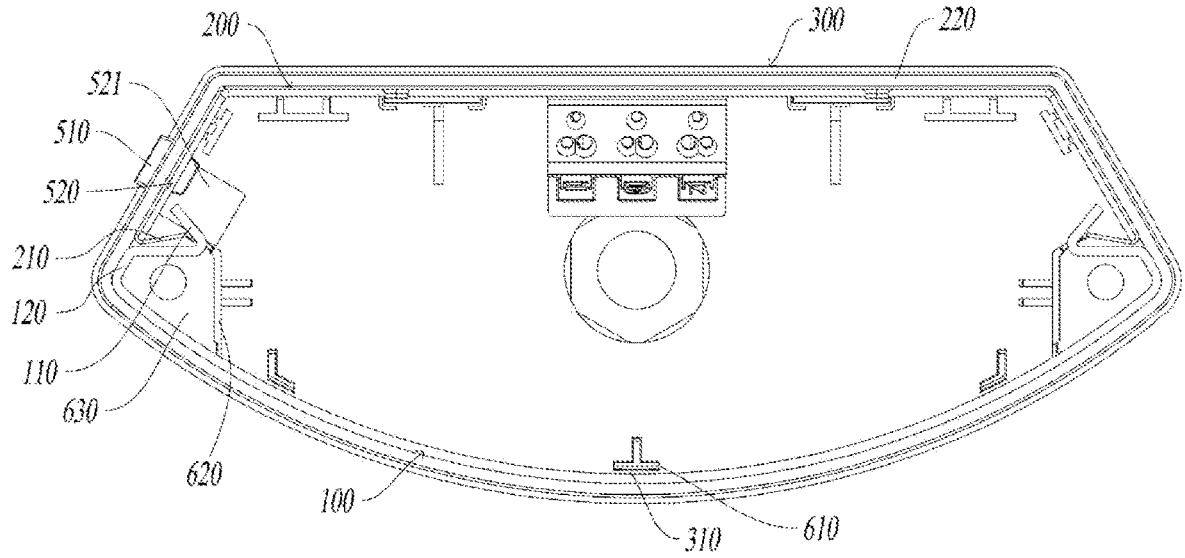
FIG. 5 is a cross-sectional view of a luminaire with a second waterproof piece disclosed in one example of the present disclosure.
Figure 6:
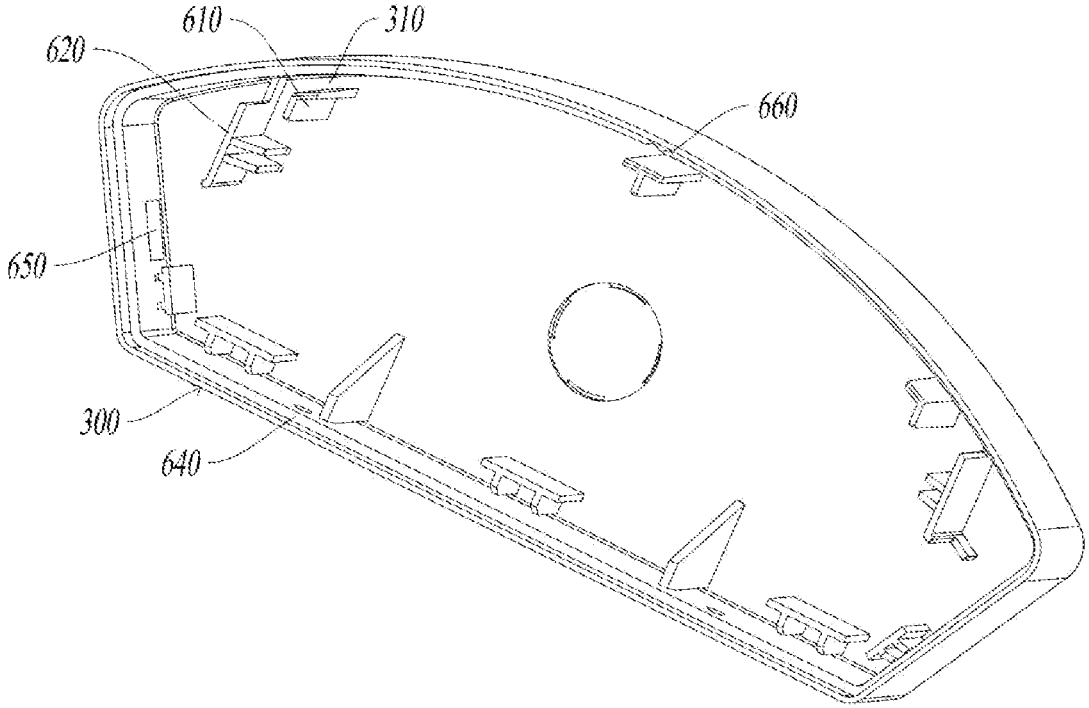
FIG. 6 is a structure diagram of a first end cap disclosed in one example of the present disclosure.
Figure 7:
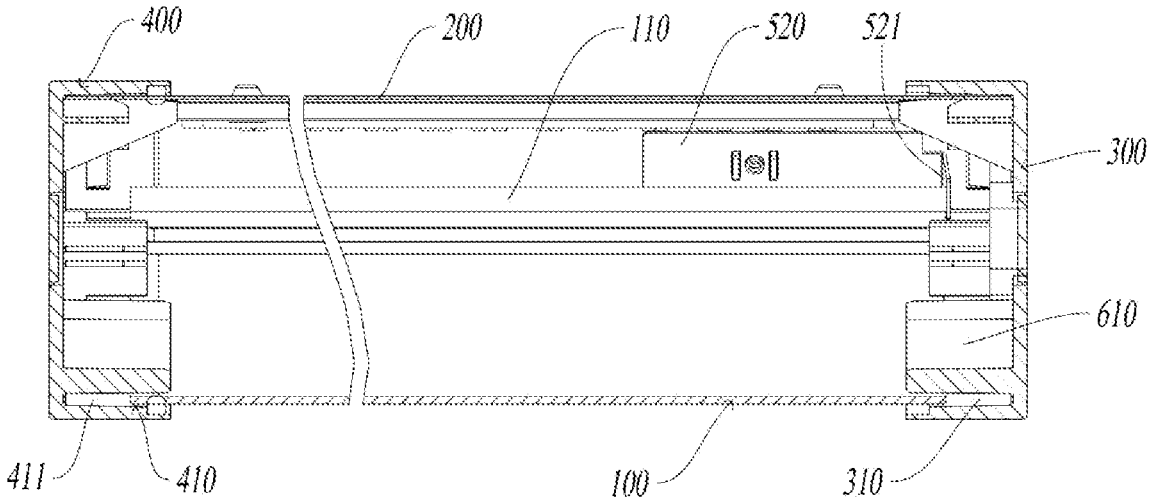
FIG. 7 is a side sectional view of a luminaire in an assembled state disclosed in one example of the present disclosure.
Figure 8:
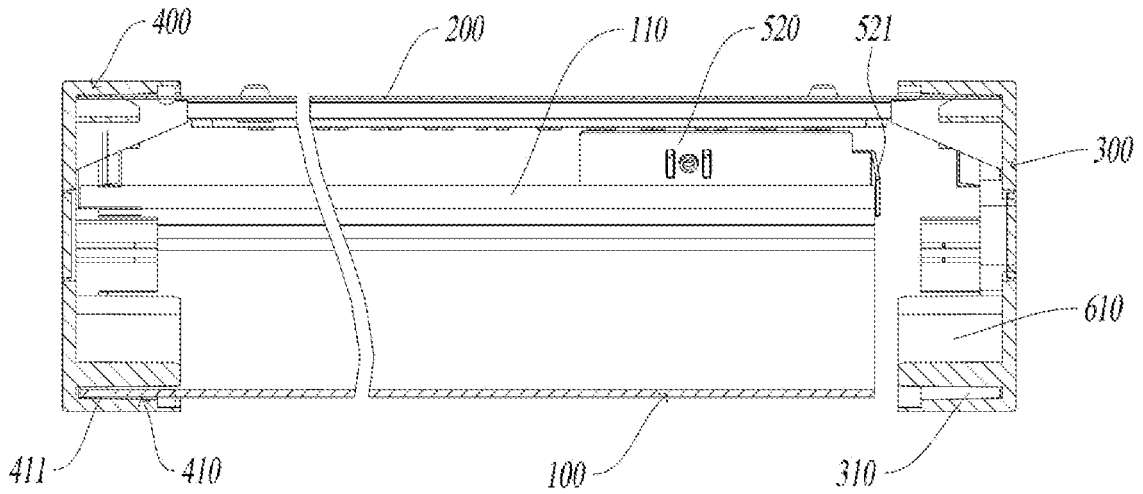
FIG. 8 is a side sectional view of a luminaire in a disassembled state disclosed in one example of the present disclosure.

As a matter of course, the positioning portion 610 may come in a plurality of structure types. For example, as shown in FIG. 4 to FIG. 6, the positioning portion 610 may be a positioning rib disposed near the sidewall of the first end cap 300 (the second end cap 400). The positioning rib may be a plurality of small-sized positioning rib arranged at intervals, and may also be one ring-shaped continuous positioning rib. A clamping groove (which is one specific form of the first limit space 310 and the second limit space 410) is formed between the positioning rib and the sidewall of the first end cap 300 (the second end cap 400). The mounting base 200 is in plug-in fit with the clamping groove, so that the mounting base 200 is in limiting stationary fit with the first end cap 300 (the second end cap 400). In another implementation, the positioning portion 610 may also be a positioning baffle, a positioning block, etc, as long as it can constrain, i.e., limit and fix, the mounting base 200.

Since the luminaire is required to have good dustproof and waterproof properties and even required to reach IP44 protection grade, higher requirements are imposed on existing luminaires. To better seal the shade 100 with the first end cap 300 and the second end cap 400 and then improve the dustproof and waterproof properties, in a more preferred solution, two ends of the shade 100 may be in limiting fit with the first limit space 310 and the second limit space 410, respectively, and a moving gap 411 is formed between the shade 100 and the second end cap 400 within the second limit space 410. Since the shade 100 is in limiting fit with the first limit space 310 and the second limit space 410, a tighter connection relationship is created, and good dustproof and waterproof effects may be achieved.

In this case, when the shade pushing assembly 500 acts on the first folded edges 110, the shade 100 is moved away from the first end cap 300 until an appropriate detaching space is formed between the shade 100 and the first end cap 300 such that the shade 100 can be taken out of the mounting base 200. As a matter of course, a range within which the force-exerting key 510 is slidable may be limited to limit a moving distance of the shade 100, which may be adaptively adjusted according to the overall size of the luminaire.

When the shade 100 slides away from the first end cap 300 relative to the mounting base 200, the shade 100, guided by the first folded edges 110 and the second folded edges 210, will be limited by the second end cap 400. The second end cap 400 will be pushed by the shade 100 off the mounting base 200. Alternatively, in the case that the mounting base 200 is also in fixed connection with the second end cap 400, the shade 100, limited by the second end cap 400, cannot be moved away from the first end cap 300 in this case. Consequently, the detaching space cannot be formed between the shade 100 and the first end cap 300. On this basis, referring to FIG. 7 and FIG. 8, when assembling the shade 100 and the second end cap 400, a moving gap 411 may be formed between the end portion of the shade 100 and the second end cap 400 within the second limit space 410. In this way, when the shade 100 is moved away from the first end cap 300, the shade 100 moves within the moving gap 411 without direct contact with the second end cap 400. Thus, the shade 100 will not be limited by the second end cap 400, and finally, the detaching space can be formed between the shade 100 and the first end cap 300. From the foregoing description, the size of the detaching space is directly affected by the moving gap 411. Therefore, during assembling, the size of the moving gap 411 may be pre-adjusted according to the desired size of the detaching space.

As a matter of course, this example of the present disclosure has no limitation on the specific connection relationship between the shade 100 and the first end cap 300 and the second end cap 400. In addition to the connection relationship in which the shade 100 is located in the first limit space 310 and the second limit space 410, the connection relationship may also be in other forms. For example, the first end cap 300 and the second end cap 400 may tightly abut against the shade 100, and the shade 100 may be pushed by the shade pushing assembly 500 to be plugged in the second limit space 410.

In the example of the present disclosure, the sliding fit relationship between the force-exerting key 510 and the mounting base 200 may come in a plurality of types. For example, the force-exerting key 510 may be in sliding fit with the sidewall of the mounting base 200 by means of balls. In a specific implementation, a sliding guide groove may be formed in the sidewall of the mounting base 200, and the force-exerting key 510 is in sliding fit with the sliding guide groove. The sliding guide groove is simple in structure and convenient to form. The sliding guide groove may be formed in the sidewall, close to the pushing piece 520, of the mounting base 200. In this case, the force-exerting key 510 has a smaller length size, and the operation convenience of the force-exerting key 510 is improved.

Figure 3:
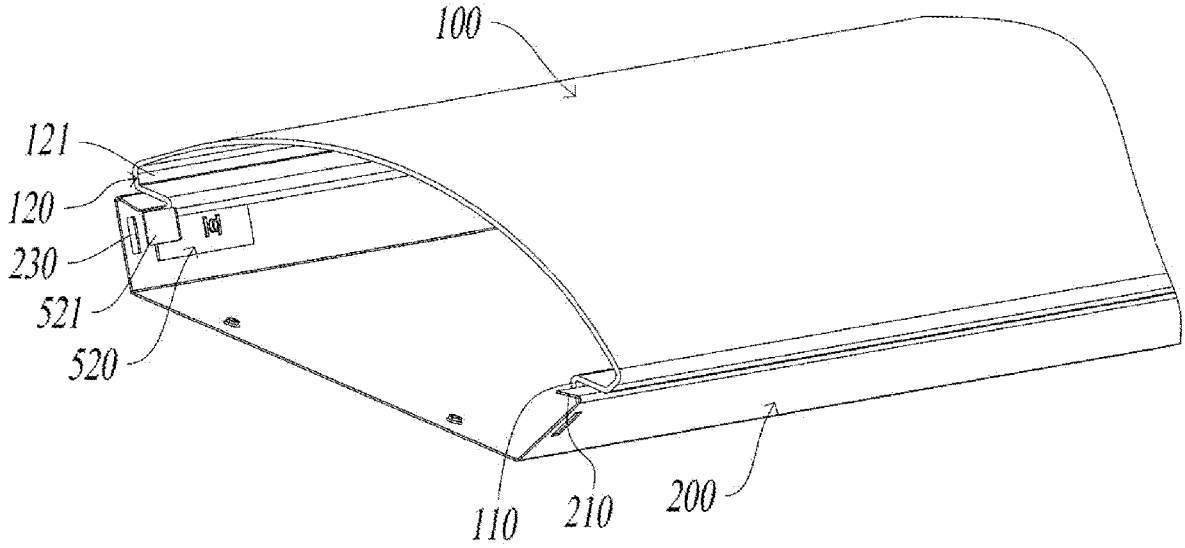
FIG. 3 is a diagram of a partial structure disclosed in one example of the present disclosure.

In the example of the present disclosure, the first folded edges 110 and the second folded edges 210 may be folded in a plurality of directions, which will not be limited herein. In a specific implementation, as shown in FIG. 3 and FIG. 4, the first folded edges 110 may be folded away from the accommodating cavity, and the second folded edges 210 may be folded toward the accommodating cavity. In this way, the first folded edges 110 and the second folded edges 210 are folded in opposite directions and may be in snap-fit with each other, thereby realizing the fixation of the shade 100 and the mounting base 200. Meanwhile, the first folded edges 110 are located on top of the second folded edges 210, and when water and dust enter the gap between the shade 100 and the mounting base 200, the second folded edges 210 will play a first role in stopping and the first folded edges 110 will play a second role in stopping. Thus, water and dust can be effectively prevented from entering the accommodating cavity.

As a matter of course, the first folded edges 110 and the second folded edges 210 prop against well. In this case, there is friction between the first folded edges 110 and the second folded edges 210, which can avoid easy relative slippage between the shade 100 and the mounting base 200 and ensure better stability of connection between the shade 100 and the mounting base 200.

In another implementation, the first folded edges 110 may be folded toward the accommodating cavity, and the second folded edges 210 may be folded away from the accommodating cavity. In this case, the first folded edges 110 and the second folded edges 210 are also folded in opposite directions and may also be in snap-fit with each other, thereby realizing the fixation of the shade 100 and the mounting base 200. It needs to be noted that the example of the present disclosure has no limitation on the specific folding angle of the first folded edges 110 and the second folded edges 210 as long as the first folded edges 110 and the second folded edges 210 can be in snap-fit with each other.

It is inevitable that there will be a mounting gap between every two of the shade 100, the mounting base 200 and the first end cap 300 (the second end cap 400). Especially, if there is a manufacturing segment gap between these structures during manufacturing, the manufacturing segment gap will cause the mounting gap to further expand at the joint, thereby affecting the dustproof and waterproof properties of the luminaire. On this basis, in a more preferred solution, as shown in FIG. 4 and FIG. 5, the shade 100 may have two opposite enclosing portions 120. The first folded edges 110 are formed at edges of each enclosing portion 120. Each enclosing portion 120 is in a bent shape and is bent toward the accommodating cavity. Specifically, the enclosing portions 120 each have a certain height and may prevent impurities such as water and dust from accumulation in the gap between the shade 100 and the mounting base 200. Thus, the amount of entering impurities can be reduced.

Since the first folded edges 110 and the second folded edges 210 can only prevent impurities such as water and dust from entering the accommodating cavity through the gap between the shade 100 and the mounting base 200, but cannot prevent the impurities from entering the accommodating cavity through the gaps between the shade 100 and the mounting base 200 and the first end cap 300 (the second end cap 400). On this basis, in a further implementation, a stop portion 620 may be disposed in each of the first end cap 300 and the second end cap 400, and the stop portion 620 and the corresponding enclosing portion 120 form an escape space 121. A first waterproof piece 630 is disposed in the escape space 121. Specifically, the escape space 121 provides a mounting space for the first waterproof piece 630. Meanwhile, the enclosing portion 120 and the stop portion 620 play a role in limiting the first waterproof piece 630, which may prevent disengagement of the first waterproof piece 630 from the joint of the shade 100, the mounting base 200 and the first end cap 300 (the second end cap 400) and thus effectively ensure the dustproof and waterproof properties of the luminaire. In the example of the present disclosure, the first waterproof piece 630 may come in a plurality of types, such as waterproof foam and waterproof rubber. Meanwhile, the stop portion 620 may come in a plurality of shapes, such as a stop block and a limiting rib. A support baffle is preferred in the example of the present disclosure.

To further improve the waterproof performance of the luminaire, in a preferred solution, a shoulder 640 is formed inward on each of the sidewall of the first end cap 300 and the sidewall of the second end cap 400, and a second waterproof piece 220 is disposed on the shoulder 640. The mounting base 200 holds down the second waterproof piece 220 on the corresponding shoulder 640. In other words, the second waterproof piece 220 is located between the mounting base 200 and the shoulder 640. Thus, the second waterproof piece 220 is held down and fixed by the mounting base 200 and the shoulder 640, thereby achieving the dustproof and waterproof effects. It needs to be noted that in the implementation of the example of the present disclosure where the shade 100 is in plug-in fit with the first limit space 310 (the second limit space 410), the shade 100 also plays a role in holding down and fixing the second waterproof piece 220. In the example of the present disclosure, the second waterproof piece 220 may come in a plurality of types, such as waterproof foam and waterproof rubber. Glands may also be disposed on the end faces of the first end cap 300 and the second end cap 400 to further optimize the waterproof performance of the first end cap 300 and the second end cap 400.

Usually, by operating the shade pushing assembly 500, finally, the shade 100 may be indirectly pushed to slide relative to the mounting base 200 and away from the first end cap 300. To avoid the formation of detaching space between the shade 100 and the first end cap 300 due to misoperation in use, in a preferred solution, the force-exerting key 510 may be connected to the pushing piece 520 by means of a threaded fastener. Specifically, when using the luminaire, the threaded fastener has been screwed down. In this case, the force-exerting key 510 and the pushing piece 520 are both in fixed connection with the mounting base 200, and therefore, the shade pushing assembly 500 is in an inoperable state. When detaching the luminaire, the threaded fastener is screwed off. In this case, a gap is formed between the mounting base 200 and each of the force-exerting key 510 and the pushing piece 520, and relative sliding is allowed. Therefore, the shade pushing assembly 500 is in an operable state, and the shade 100 may be pushed to slide relative to the mounting base 200 and away from the first end cap 300, so that the detaching space is formed between the shade 100 and the first end cap 300. It needs to be noted that the threaded fastener may be a screw, a bolt, etc. As a matter of course, the example of the present disclosure has no limitation on the specific connection relationship between the force-exerting key 510 and the pushing piece 520. For example, the force-exerting key 510 and the pushing piece 520 may also be integrally molded.

To ensure good mounting stability and sliding smoothness of the pushing piece 520 and the effectiveness of acting of a third folded edge 521 on the first end face, in a preferred solution, the pushing piece 520 may be plate-like to fit on at least a portion of the sidewall of the mounting base (200). Specifically, the plate-like pushing piece 520 may tightly fit on the sidewall of the mounting base 200, and dislocation of the pushing piece 520 may thus be avoided. Meanwhile, when the force-exerting key 510 slides relative to the mounting base 200, the pushing piece 520 fits on the sidewall of the mounting base 200 to realize smoother sliding.

The pushing piece 520 has a third folded edge 521, and the third folded edge 521 is folded to abut against the first end face. Specifically, the first end face has a small size, and the third folded edge 521 is plate-like (the plate-like third folded edge 521 has a larger area) is more prone to contact with the first end face, thereby avoiding dislocation therebetween. As a result, it can be ensured that the third folded edge 521 smoothly acts on the first end face.

To simplify the structure and ensure the effectiveness of acting of the shade pushing assembly 500 on the shade 100, in a preferred solution, the pushing piece 520 abuts against one of the two first end faces that is closer to the force-exerting key 510. Since there are two first folded edges 110 opposite to each other, there are two first end faces. The structure may be inevitably complicated for realizing abutting of the first end face further from the force-exerting key 510 against the pushing piece 520, and the effectiveness of interaction therebetween will be weakened. Therefore, it is preferred that the pushing piece 520 abuts against the first end face closer to the force-exerting key 510.

Referring to FIG. 3 and FIG. 6, a clamping projection 650 is formed on each of the sidewall of the first end cap 300 and the sidewall of the second end cap 400, while a clamping recess 230 is formed in the sidewall of the mounting base 200, and each clamping projection 650 is in clamping fit with the clamping recess 230. Specifically, when the clamping projection 650 is in clamping fit with the clamping recess 230, stationary fit between the mounting base 200 and the first end cap 300 (the second end cap 400) is realized, thereby avoiding easy disengagement. The sidewall of the first end cap 300 (the second end cap 400) protrudes inwards to form a clamping projection 650. A surface, facing the mounting base 200, of the clamping projection 650 may be an inclined surface, which is conducive to the sliding of the clamping projection 650 into the clamping recess 230 and more convenient for assembling. The clamping recess 230 may be structured as a groove or a limiting hole. As a matter of course, the example of the present disclosure has no limitation on the specific types of the clamping projection 650 and the clamping recess 230.

In the example of the present disclosure, a drainage hole 660 may be formed in each of the bottom of the first end cap 300 and the bottom of the second end cap 400. The drainage hole 660 is communicated with the accommodating cavity. Thus, the luminaire is allowed to cope with the potential risk of water present in the luminaire. Meanwhile, when mounting the luminaire, water will flow to the lower end due to a height difference between the two ends of the luminaire, and finally is discharged through the drainage hole 660 in the lower end, thereby protecting the luminaire.

For the sake of better appearance of the luminaire, in a preferred solution, the mounting base 200 may be a metal part. With the development of society, users have higher requirements on the quality of life. Due to the limitations of manufacturing process cost and mold investment, existing luminaires are still manufactured by processes such as extrusion, resulting in obvious plastic appearance of the luminaires and thus failing to meet the requirements of users. In the example of the present disclosure, the mounting base 200 formed by a metal part can make the luminaire have prominent metal texture, thereby significantly improving the appearance of the entire luminaire and making the luminaire product look like better.

Meanwhile, as a metal part, the mounting base 200 will have excellent heat dissipation performance. Moreover, the strength of the mounting base 200 will be improved significantly, which is conducive to providing better support for other components of the luminaire. As a matter of course, the metal part of the mounting base 200 may come in a plurality of types, such as an iron part, an aluminum part and a steel part. The example of the present disclosure has no limitation on the specific metal part type of the mounting base 200.

Figure 9:
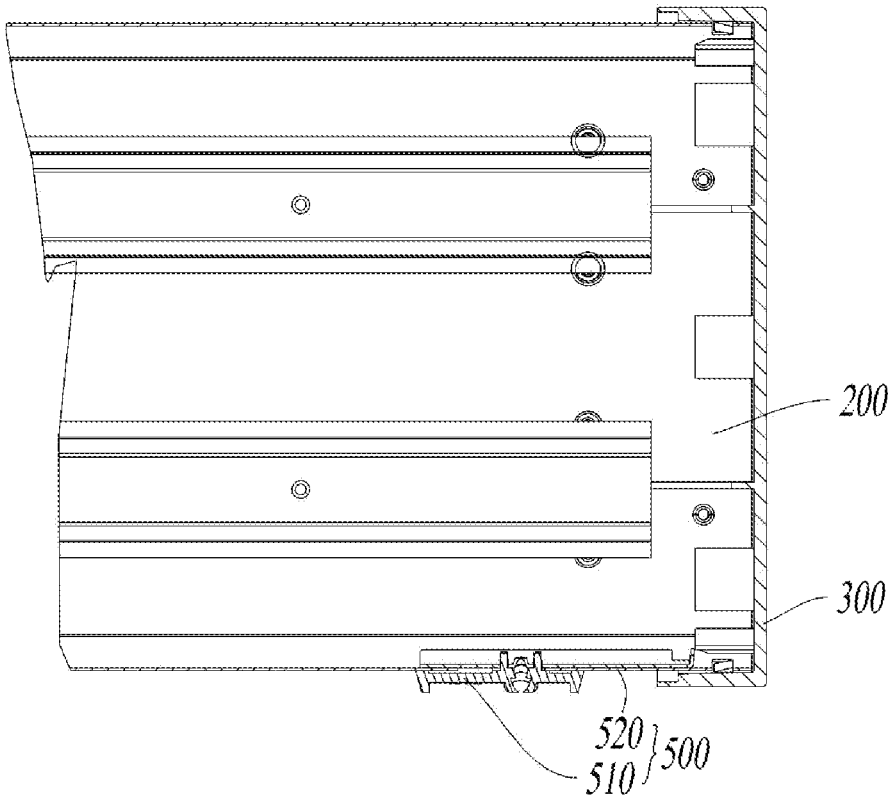
FIG. 9 is a partial top view of a luminaire disclosed in one example of the present disclosure.
Figure 10:
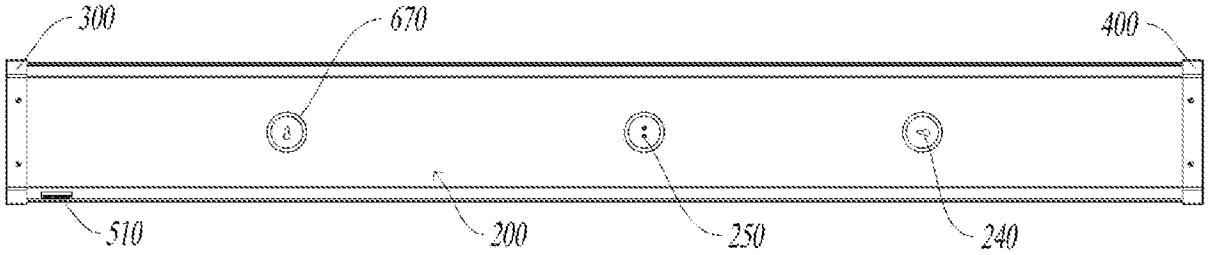
FIG. 10 is a bottom view of a mounting base disclosed in one example of the present disclosure.

The luminaire disclosed in the example of the present disclosure may be a ceiling lamp, a wall lamp, etc. The example of the present disclosure has no limitation on the specific type of the luminaire. In the example of the present disclosure, the lamp may be preferably a ceiling lamp. A mounting hole 240 and a wiring hole 250 are formed in a bottom surface of the mounting base 200. Referring to FIG. 9, in a preferred solution, a third waterproof piece 670 may be disposed around each of mounting hole 240 and the wiring hole 250. Specifically, the third waterproof pieces 670 are capable of achieving the waterproof effect around the mounting hole 240 and the wiring hole 250 on the one hand; on the other hand, the waterproof material typically has certain flexibility and thus is capable of buffering destructive action such as squeezing and collision. During the mounting of the ceiling lamp, the third waterproof pieces 670 are capable of protecting the mounting hole 240 and the wiring hole 250 to a certain extent, thereby avoiding damage to the mounting hole 240 and the wiring hole 250. In the example of the present disclosure, the third waterproof piece 670 may also come in a plurality of types, such as waterproof foam and waterproof rubber.

The technical solutions adopted by the present disclosure can achieve following beneficial effects.

In the luminaire disclosed in an example of the present disclosure, a pushing piece abuts against a first end face of at least one of first folded edges, and the first end face is the end face on a side, facing a first end cap, of the first folded edge. Since the force-exerting key portion connected to the pushing piece partially extends out of the mounting base and the force-exerting key is in sliding fit with the sidewall of the mounting base, the force-exerting key can be operated outside the mounting base to move for driving the pushing piece such that the shade can be pushed to slide relative to the mounting base and away from the first end cap. The sliding of the shade relative to the mounting base is achieved by means of the relative sliding between the first folded edges and the second folded edges. When the shade is moved away from the first end cap, a gap is formed between the shade and the first end cap, and the shade may be captured from the gap. Since the shade is flexible to a certain extent, the shade may be taken out of the mounting base with a small force. Thus, detachment of the entire luminaire is avoided. Compared with the way where the shade can be removed only after the end caps are removed in the prior art, the operation is simpler and more convenient with higher detaching efficiency.

The foregoing description of each example of the present disclosure focuses on the differences from other example. Different optimized features of various examples can be combined to derive a better example as long as they do not contradict each other, which will not be reiterated here in consideration of simplicity of wording.

The foregoing is merely illustrative of the examples of the present disclosure and is not intended to limit the present disclosure. Various changes and modifications can be made to the present disclosure by those skilled in the art. Any modifications, equivalent replacements, improvements, etc. made within the spirit and scope of the present disclosure should be included within the protection scope of the present disclosure.

The invention claimed is:

1. A luminaire, comprising a shade, a mounting base, a first end cap, a second end cap, a light source module and a drive power source, wherein the shade has two first folded edges opposite to each other, and the mounting base has two second folded edges opposite to each other; the first folded edges are in snap-fit with the second folded edges;

the first end cap and the second end cap are respectively connected to two ends of the mounting base; the shade, the mounting base, the first end cap and the second end cap form an accommodating cavity, and the light source module and the drive power source are disposed in the accommodating cavity;

the luminaire further comprises a shade pushing assembly, and the shade pushing assembly comprises a force-exerting key and a pushing piece; the force-exerting key is in sliding fit with a sidewall of the mounting base, and the pushing piece is located in the accommodating cavity; one end of the force-exerting key is connected to the pushing piece, and the other end of the force-exerting key extends out of the mounting base;

the pushing piece abuts against a first end face of at least one of the first folded edges, and the first end face is an end face on a side, which is facing the first end cap, of the first folded edge; a movement of the force-exerting key causes the pushing piece to move for driving the shade to slide relative to the mounting base and away from the first end cap.

2. The luminaire according to claim 1, wherein a positioning portion is disposed in each of the first end cap and the second end cap; a first limit space is formed between the positioning portion and a sidewall of the first end cap, and a second limit space is formed between the positioning portion and a sidewall of the second end cap; and the two ends of the mounting base are respectively in limiting fit with the first limit space and the second limit space.

3. The luminaire according to claim 2, wherein two ends of the shade are respectively in limiting fit with the first limit space and the second limit space, and a moving gap is formed between the shade and the second end cap within the second limit space.

4. The luminaire according to claim 1, wherein a sliding guide groove is formed in the sidewall of the mounting base, and the force-exerting key is in sliding fit with the sliding guide groove.

5. The luminaire according to claim 1, wherein the first folded edge is folded away from the accommodating cavity, and the second folded edge is folded toward the accommodating cavity.

6. The luminaire according to claim 5, wherein the shade has two opposite enclosing portions; the first folded edges are formed at edges of each enclosing portion; each enclosing portion is in a bent shape and is bent toward the accommodating cavity;

a stop portion is disposed in each of the first end cap and the second end cap, and the stop portion and the corresponding enclosing portion form an escape space; and a first waterproof piece is disposed in the escape space.

7. The luminaire according to claim 1, wherein a shoulder is formed inward on each of the sidewall of the first end cap and the sidewall of the second end cap;

a second waterproof piece is disposed on the shoulder, and the mounting base holds down the second waterproof piece on the shoulder.

8. The luminaire according to claim 1, wherein the force-exerting key is connected to the pushing piece through a threaded fastener.

9. The luminaire according to claim 1, wherein the pushing piece is plate-like to fit on at least a portion of the sidewall of the mounting base;

the pushing piece has a third folded edge, and the third folded edge is folded to abut against the first end face.

10. The luminaire according to claim 1, wherein the pushing piece abuts against one of the two first end faces that is closer to the force-exerting key.

11. The luminaire according to claim 1, wherein a clamping projection is formed on each of a sidewall of the first end cap and a sidewall of the second end cap, a clamping recess is formed in the sidewall of the mounting base, and each clamping projection is in clamping fit with the clamping recess.

12. The luminaire according to claim 1, wherein a drainage hole is formed in each of a bottom of the first end cap and a bottom of the second end cap, and the drainage hole is communicated with the accommodating cavity.

13. The luminaire according to claim 1, wherein the mounting base is a metal part.

14. The luminaire according to claim 1, wherein the luminaire is a ceiling lamp, and a mounting hole and a wiring hole are formed in a bottom surface of the mounting base.

15. The luminaire according to claim 14, wherein a third waterproof piece is disposed around each of the mounting hole and the wiring hole.

* * * * *